US006481135B2

(12) United States Patent
Zeh et al.

(10) Patent No.: US 6,481,135 B2
(45) Date of Patent: Nov. 19, 2002

(54) ROTATABLE BREECH MECHANISM

(75) Inventors: Meinrad Zeh, Weitnau (DE); Sergej Popikow, Weitnau (DE)

(73) Assignee: Blaser Jagdwaffen GmbH, Isny (DE)

( * ) Notice: Subject to any disclaimer, the term of this patent is extended or adjusted under 35 U.S.C. 154(b) by 0 days.

(21) Appl. No.: 09/737,436

(22) Filed: Dec. 13, 2000

(65) Prior Publication Data

US 2001/0016997 A1 Aug. 30, 2001

(30) Foreign Application Priority Data

Dec. 18, 1999 (DE) ..... 199 61 188

(51) Int. Cl.[7] ..... F41A 3/72
(52) U.S. Cl. ..... 42/16; 42/25
(58) Field of Search ..... 42/16, 25

(56) References Cited

U.S. PATENT DOCUMENTS

| | | | | | |
|---|---|---|---|---|---|
| 157,783 | A | * | 12/1874 | Berdan | 42/25 |
| 1,860,157 | A | | 5/1932 | Payne | |
| 3,707,795 | A | * | 1/1973 | Bielfeldt | 42/16 |
| 3,979,849 | A | | 9/1976 | Haskins | 42/16 |
| 4,152,855 | A | | 5/1979 | DuBiel et al. | 42/16 |
| 4,920,677 | A | | 5/1990 | Schuerman | 42/16 |
| 5,722,194 | A | * | 3/1998 | Wurger et al. | 42/69.02 |

FOREIGN PATENT DOCUMENTS

| | | | | |
|---|---|---|---|---|
| AT | 759051/393 | * | 11/1944 | 42/16 |
| CH | 41612 | * | 11/1907 | 42/16 |
| DE | 690 572 | | 4/1940 | |
| DE | 37 18 431 C2 | | 12/1988 | 42/16 |
| GB | 778083 | * | 7/1957 | 42/16 |

OTHER PUBLICATIONS

Waffen lexicon Neuausgabe, ©1981 BLV Verlagsgesellschaft mbH, Muenchen Gesamtherstellung: Druckerei Ludwig Auer, Donauwoerth Printed in Germany—ISBN 3–405–12037–3 (3 pages).

* cited by examiner

*Primary Examiner*—Stephen M. Johnson
(74) *Attorney, Agent, or Firm*—Flynn, Thiel, Boutell & Tanis, P.C.

(57) ABSTRACT

A rotatable breech mechanism includes a bolt rotatably supported in a chamber housing by a bolt handle, and which in one rotated position thereof is locked to a barrel chamber sleeve and in a further rotated position thereof is unlocked from the sleeve. A spring-loaded extractor is arranged at a front end of the bolt. The extractor, in one rotated position of the bolt, grips an edge of a bottom of a sleeve of a cartridge inserted into a cartridge chamber, whereby upon a rotation of the bolt from the one position into a further position the chamber housing with the bolt automatically carries out a movement away from the cartridge chamber during which the extractor releases the cartridge from the cartridge chamber. The chamber housing supports an axially movable pin which is supported at its front end on the barrel chamber sleeve. In one rotated position of the bolt, a rear end of the pin is received in a forwardly open recess of a shoulder surface on the bolt handle, and upon a rotation of the bolt out of the one position the rear end of the pin slides out of the recess onto the shoulder surface, and the chamber housing with the bolt is movable to a rearward position.

6 Claims, 3 Drawing Sheets

C-C

1
L2
17
C
C
18
4
20
12
3
L4
14

17
4
18
19
12
D-D
13
2

3
19
10
12
C-C
5
2
D
D

ROTATABLE BREECH MECHANISM

FIELD OF THE INVENTION

The invention relates to a rotatable breech mechanism.

BACKGROUND OF THE INVENTION

To release a cartridge from a cartridge chamber utilizing a rotatable breech mechanism, it is known from the DE 37 18 431 C2 to provide a spring-loaded extractor at the front end of the chamber, which extractor, when the chamber is closed, grips in front of the edge of the bottom of the sleeve of a cartridge inserted into the cartridge housing. A raised projection exists at the front end of the chamber, which projection is in contact with an inclined extending ramp on the sleeve of the chamber. When the chamber is moved into the open position by the chamber handle, then the raised projection is then moved along the inclined extending ramp, thus automatically causing the chamber housing to carry out a movement rearwardly away from the cartridge chamber. The cartridge is hereby released from the cartridge chamber by the extractor.

This known construction has the disadvantage that the inclined extending ramp is difficult to mount on the sleeve of the chamber.

It is necessary in the known rotatable breech mechanisms to lock the chamber in the opened position since otherwise due to the weight of the chamber handle the chamber would pivot into a closed position. In order to guarantee this, a spring-loaded pin is arranged at the front end of the chamber housing, which pin, in the closed position of the chamber, rests with its face against the rear end of the sleeve of the chamber and is hereby disengaged from the chamber. When the breech guide is moved rearwardly and the pin disengages from the sleeve of the chamber, it then engages the chamber or rather a chamber guide when the chamber is in the open position.

The lock between chamber housing and chamber is accomplished by a pressure bolt in the DE 690 572 C.

SUMMARY OF THE INVENTION

The purpose exists to provide a rotatable breech mechanism in such a manner that the movement of the chamber housing with the chamber for operating the extractor is exclusively controlled by the rotating movement of the chamber handle.

The pin, which is axially movably supported in the chamber housing, does not only have the purpose that upon a rotation of the chamber handle from one position (from the closed position) in direction of the other position (the opened position) the chamber housing carries out a movement away from the cartridge chamber but also makes it possible that the pin locks the chamber in the other (opened) position.

BRIEF DESCRIPTION OF THE DRAWINGS

One exemplary embodiment will be discussed in greater detail hereinafter in connection with the drawings, in which.

DETAILED DESCRIPTION

Figure 1:
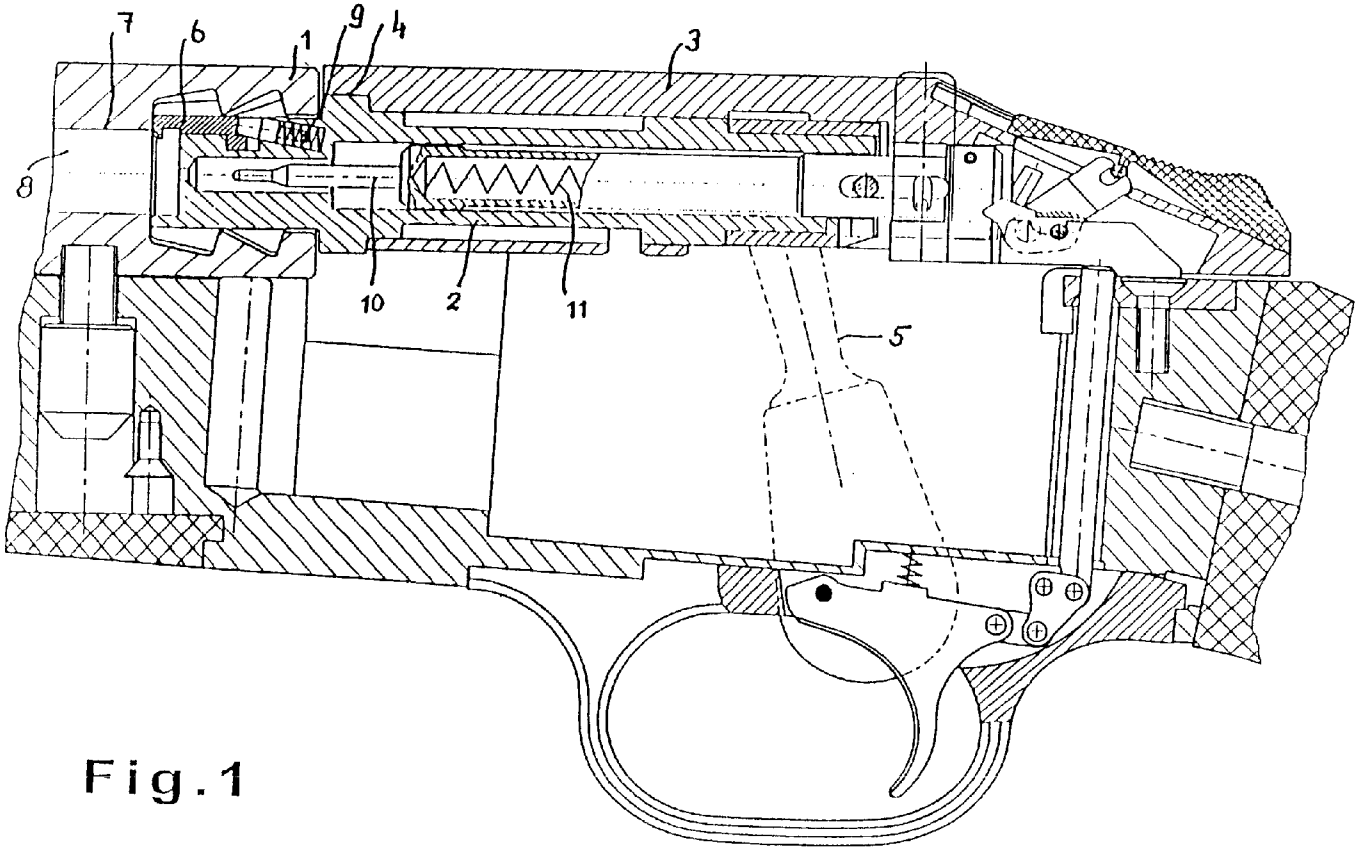
FIG. 1 is a cross-sectional view of the chamber lock.

The rotatable breech mechanism according to FIG. 1 is illustrated in a locking position and has a stationary barrel chamber sleeve 1 with which the front end of a bolt 2 with an interior chamber is engaged. The bolt or chamber 2 is supported rotatably and axially nonmovably by the chamber housing 3, for which purpose among others a chamber guide 4 is used. The bolt 2 is rotated by operating a bolt handle or chamber handle 5. When the bolt 2 is engaged with the chamber sleeve 1, then a spring-loaded extractor 6 grips in front of the edge of the bottom of the sleeve of a cartridge 8 inserted into the cartridge chamber 7. The extractor 6 is maintained in engagement with the edge of the bottom of the sleeve by a spring 9. The bolt 2 has a firing pin 10 and a cocked firing-pin spring 11. FIG. 1 illustrates the parts with the breech mechanism being closed and the firing-pin spring 1 being cocked, whereby the bolt handle 5 is in its lowered position.

Figures 2, 3, 4, 5:
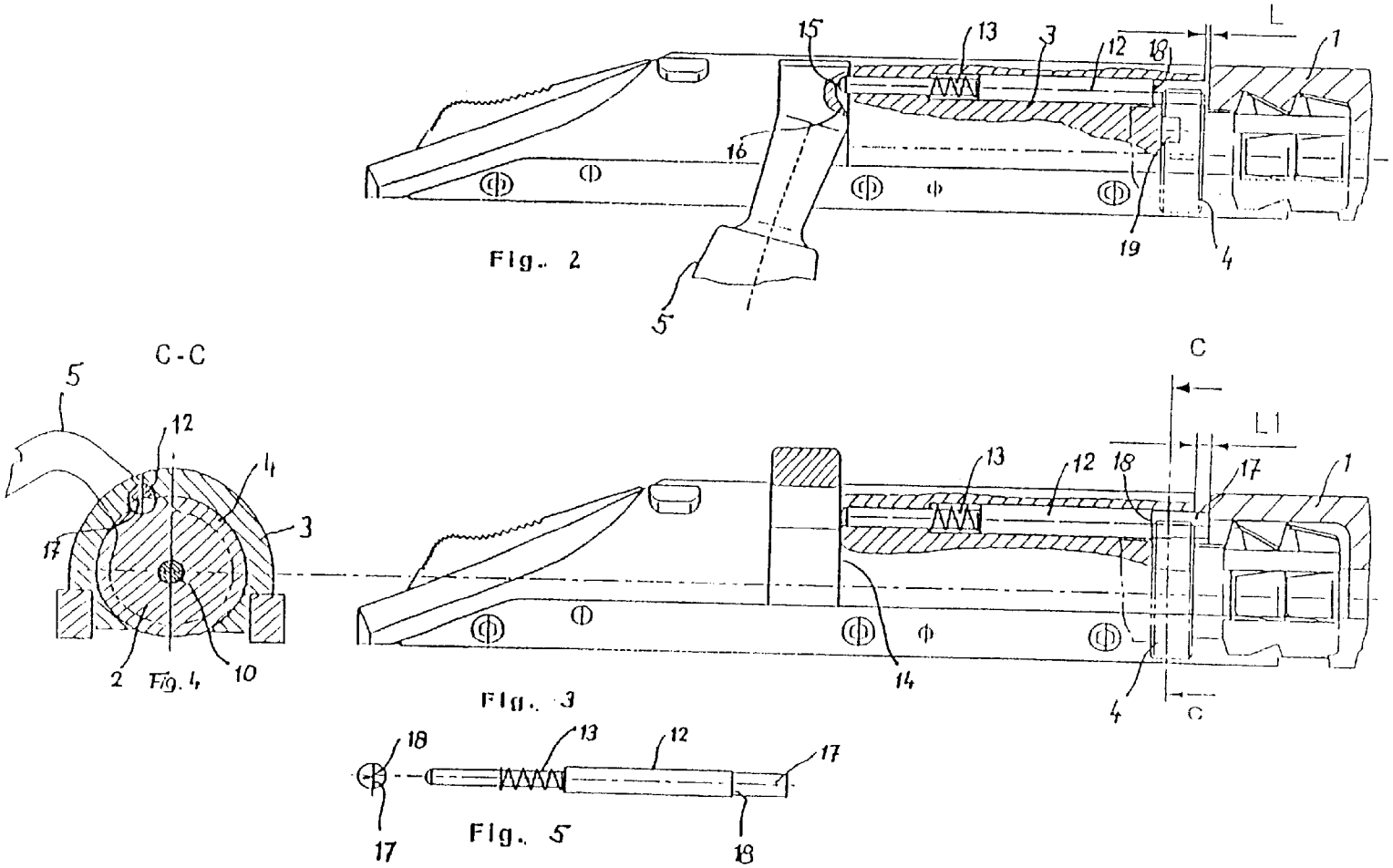
FIG. 2 is a partially cross-sectioned side view of the chamber housing containing the chamber and the chamber sleeve with the weapon being locked.
FIG. 3 is an illustration corresponding to FIG. 2, in which the chamber housing is in a first position.
FIG. 4 is a cross-sectional view taken along the line C—C of FIG. 3.
FIG. 5 is a front and side view of the pin.

The open position of the breech mechanism is illustrated in FIG. 4 which shows a pin 12 supported for axial movement on the chamber housing 3. The pin 12 rests with its front end against the rear face of the chamber sleeve 1. The clearance-free engagement is caused by a spring 13 which presses the pin 12 in direction of the chamber sleeve 1.

The chamber handle 5 has a shoulder surface 14 in which a recess 15 is provided. The rear end of the pin 12 is received into the recess when the rotatable breech mechanism is in its closed position. The recess 15 has a flat ramp surface 16 therein. When the rear end of the pin 12 is in the recess 15, then a narrow gap L exists between the rear face of the chamber sleeve 1 and the front end of the chamber housing 3.

When the chamber handle 5 is pivoted (when viewing the firearm from the rear, counterclockwise in FIG. 1) upwardly from the closed position into the open position, then the pin 12 is moved axially forwardly by the ramp 16. The lock between the chamber 2 and the chamber sleeve 1 is hereby released. Since the front end of the pin 12 is supported on the rear face of the chamber sleeve 1, the chamber housing 3 and the chamber 2 carry out a movement rearwardly away from the chamber sleeve 1. Upon a further rotation of the chamber handle, the rear end of the pin 12 rests then against the shoulder surface 14. By moving the chamber 2 away from the chamber sleeve 1, the extractor 6 releases (or pulls) the cartridge 8 from the cartridge chamber 7. Upon a further movement of the chamber housing 3 to the rear, the cartridge 8 is pulled completely out of the cartridge chamber 7.

As soon as the rear end of the pin 12 is no longer in contact with the ramp 16, a gap L1 exists between the rear end of the chamber sleeve 1 and the front end of the chamber housing 3.

The above description includes the extractor function of the pin 12. This extractor function will be described hereinafter for the chamber 2 when the breech mechanism is in its open position.

The pin 12 has a flat area 17 at its front end, which flat area forms a step 18. The bore 20 supporting the pin 12 is, in the area of the chamber guide 4, open toward same. The chamber guide 4 has a groove 19 (FIG. 7) in its periphery.

Figures 6, 7, 8:
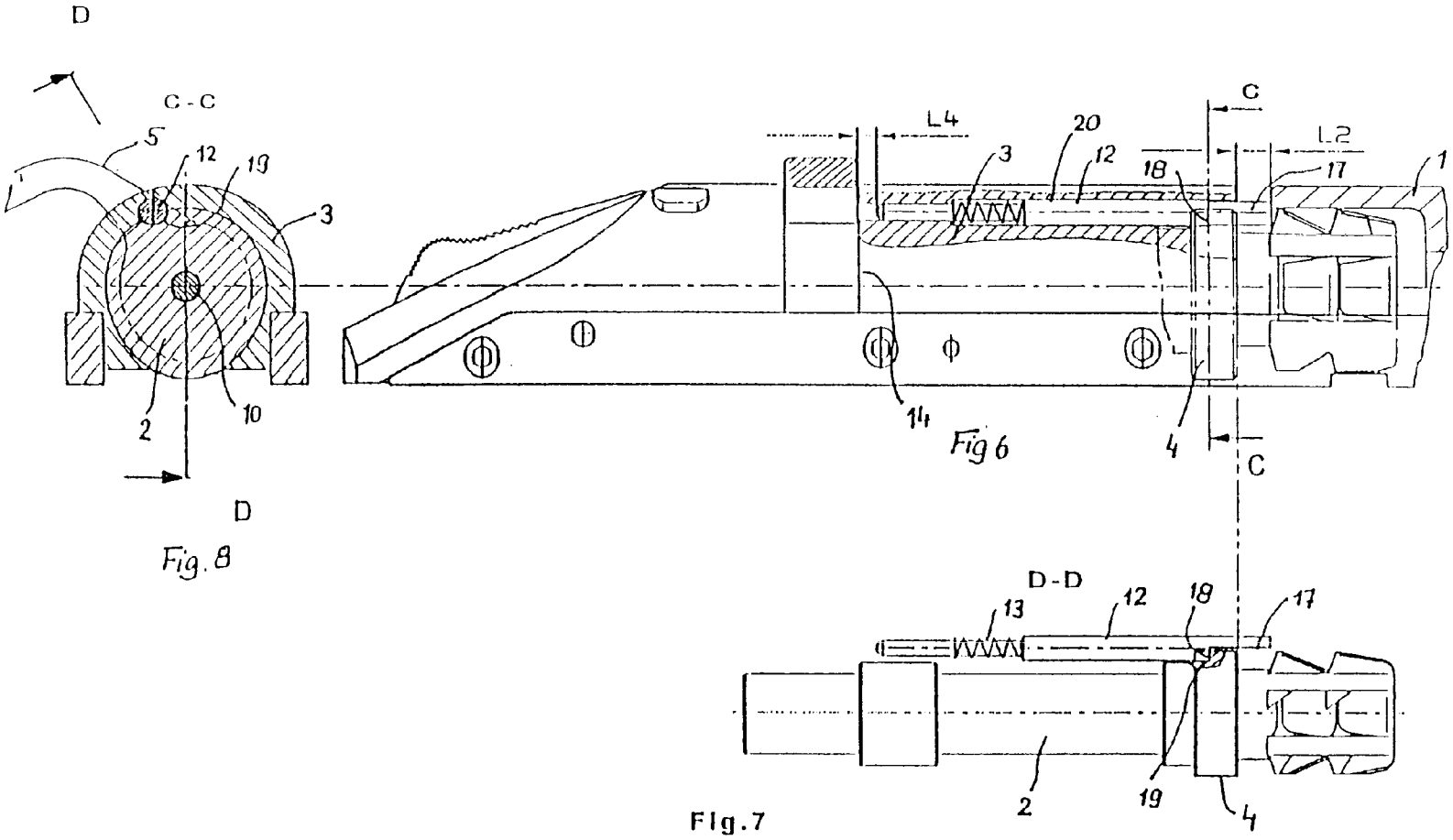
FIG. 6 is an illustration corresponding to FIG. 2 shortly prior to the pin moving out of contact with the chamber sleeve.
FIG. 7 is a cross-sectional view taken along the line D—D of FIG. 8.
FIG. 8 is a cross-sectional view taken along the line C—C of FIG. 6.

The flat area 17 extends, in the closed position of the breech mechanism according to FIG. 2, beyond the chamber guide 4 and rests with its front end against the rear face of the chamber sleeve 1. At the end of the path of movement of L to L1, the step 18 rests on the rear face of the chamber guide 4. When the breech mechanism is manually pulled rearwardly into a position as illustrated in FIG. 6, the spring 13 continues to press the pin 12 then into the groove 19 with the step 18 resting against the front end of the groove 19 as shown in FIGS. 6 and 7. The chamber 2 and the chamber handle 5 are now in this open position locked to the pin 12 or to the chamber housing 3.

When the breech mechanism is pressed forwardly, namely from the position according to FIG. 6 into the one according to FIG. 3, then the shoulder 18 on the pin 12 is removed from the groove 19, thus causing the chamber handle 5 to be able to be pivoted downwardly to the closed position. That is, and referring to FIG. 6, the forward end of the pin 12, when moving forward, strikes the rear surface of the chamber sleeve 1. As the handle 5 is thereafter pushed forward, the pin 12 is moved to the left relative to the forward moving chamber housing 3 by the distance L4 so that the shoulder 18 is moved away from the groove 19.

What is claimed is:

1. A rotatable breech mechanism, in combination with a spring-loaded extractor, bolt handle and barrel chamber sleeve, comprising a bolt rotatable in a chamber housing by said bolt handle, and which is locked in a first position to said barrel chamber sleeve and is unlocked in a second position from said barrel chamber sleeve, said spring-loaded extractor arranged at a front end of said bolt, said extractor gripping in the first position of said bolt in front an edge of a bottom of a sleeve of a cartridge positioned in a cartridge chamber, whereby upon a rotation of said bolt from the first position into the second position, said chamber housing with said bolt automatically carries out a movement away from the cartridge chamber, during which said extractor releases the cartridge from the cartridge chamber, wherein said chamber housing supports axially movably a pin, said pin supported at a front end on said chamber sleeve, in the first position of said bolt a rear end of said pin engages a forwardly open recess of a shoulder surface on said bolt handle, and upon a rotation of said bolt from the first position the rear end of said pin slides out of the recess onto the shoulder surface, and the chamber housing with said bolt is moved to the rear into a rearward position.

2. The combination according to claim 1, wherein the recess has a flat ramp surface extending along a portion of the shoulder surface.

3. The combination according to claim 1, wherein said pin is pressed by a spring.

4. The combination according to claim 1, wherein, when said chamber housing is moved into the rearward position, said pin presses against a rear face of a chamber guide, the chamber guide having an axially extending groove on its periphery, and upon a further pulling back of said breech mechanism, said pin is pressed into the groove.

5. The combination according to claim 4, wherein said pin has a flat area extending beyond the chamber guide, the flat area being pressed against an edge of the chamber guide by a step formed in the flat area and received in the groove.

6. The combination according to claim 5, wherein a bore in said chamber housing supports said pin and opens toward the chamber guide.

* * * * *